United States Patent [19]

Nieto

[11] Patent Number: 4,500,090

[45] Date of Patent: Feb. 19, 1985

[54] POLYHEDRAL PUZZLE

[76] Inventor: Antoliano Nieto, 3421 Drummond St. - Apt. 15, Montreal, Canada, H3G 1X7

[21] Appl. No.: 378,293

[22] Filed: May 14, 1982

[51] Int. Cl.[3] ..... A63F 9/08

[52] U.S. Cl. ..... 273/153 S

[58] Field of Search ..... 273/153 R, 153 S, 155; 46/25

[56] References Cited

U.S. PATENT DOCUMENTS 2,972,833 2/1981 La Grutta ..... 46/25

FOREIGN PATENT DOCUMENTS

G8104382.1 7/1981 Fed. Rep. of Germany ... 273/153 S 55-3956 1/1980 Japan ..... 273/153 S

*Primary Examiner*—Anton O. Oechsle

[57] ABSTRACT

A polyhedral puzzle made up of a central body element, and intermediate and external body elements and characterized by the intermediate elements and the external elements being constructed and arranged to move in planet carriers and planet gears fashion respectively relative one to another in the polyhedral puzzle assembly and for selective displacement of the external elements over the entire outer surface of the assembly. This cubic puzzle includes a central body of polyhedron shape on the faces of which are pivoted the intermediate body elements slidably carrying the external body elements.

3 Claims, 9 Drawing Figures

POLYHEDRAL PUZZLE

FIELD OF THE INVENTION

This invention relates to a polyhedral puzzle of the type made of a plurality of interconnected bodies that are arranged for relative displacement between them.

DESCRIPTION OF THE PRIOR ART

There is known a cubic puzzle wherein all the interconnected bodies constitute a cube, are assembled to cooperatively form a larger cube, and are provided with either one, two or three outer faces. Thus, the smaller cube elements define three functionally distinct elements: a surface element, an edge element, or a corner element respectively in relation with their positions on the larger cube. This produces a very specific puzzle in combination with a specific set of colors put on those outer faces of the cube elements. That known cubic puzzle is played by rotational translation of the cubic elements in planes parallel to the faces of the larger cube.

SUMMARY OF THE INVENTION

It is a general object of the present invention to provide a polyhedral puzzle of the above type having a different construction to be played in a different and interesting manner.

It is another general object of the present invention to provide a polyhedral puzzle of the above type wherein all the outer elements are of the same shape and positionable anywhere around the corresponding polyhedral puzzle assembly.

It is a further general object of the present invention to provide a polyhedral puzzle of the above type wherein the component elements are moved by rotational translation in planetary gear fashion over the entire outer surface of the polyhedral puzzle assembly.

It is a more specific object of the present invention to provide a polyhedral puzzle of the above type that is made with component elements including intermediate elements and external elements relatively movable in planet carriers and planet gears fashion respectively relative one to another in the polyhedral puzzle assembly.

This invention defines a polyhedral puzzle made up of a central body element, intermediate body elements, and external body elements and characterized by the intermediate elements and the external elements being constructed and arranged to move in planet carriers and planet gears fashion respectively relative one to another in the polyhedral puzzle assembly and for selective displacement of the external elements over the entire outer surface of the assembly. This polyhedral puzzle includes a central body of polyhedron shape on the faces of which are pivoted the intermediate body elements slidably carrying the external body elements.

BRIEF DESCRIPTION OF THE DRAWINGS

The above and other objects and advantages of the present invention will be better understood with reference to the following detailed description of a preferred embodiment thereof which is illustrated, by way of example, in the accompanying drawings; in which.

DESCRIPTION OF THE PREFERRED EMBODIMENT

Figure 1:
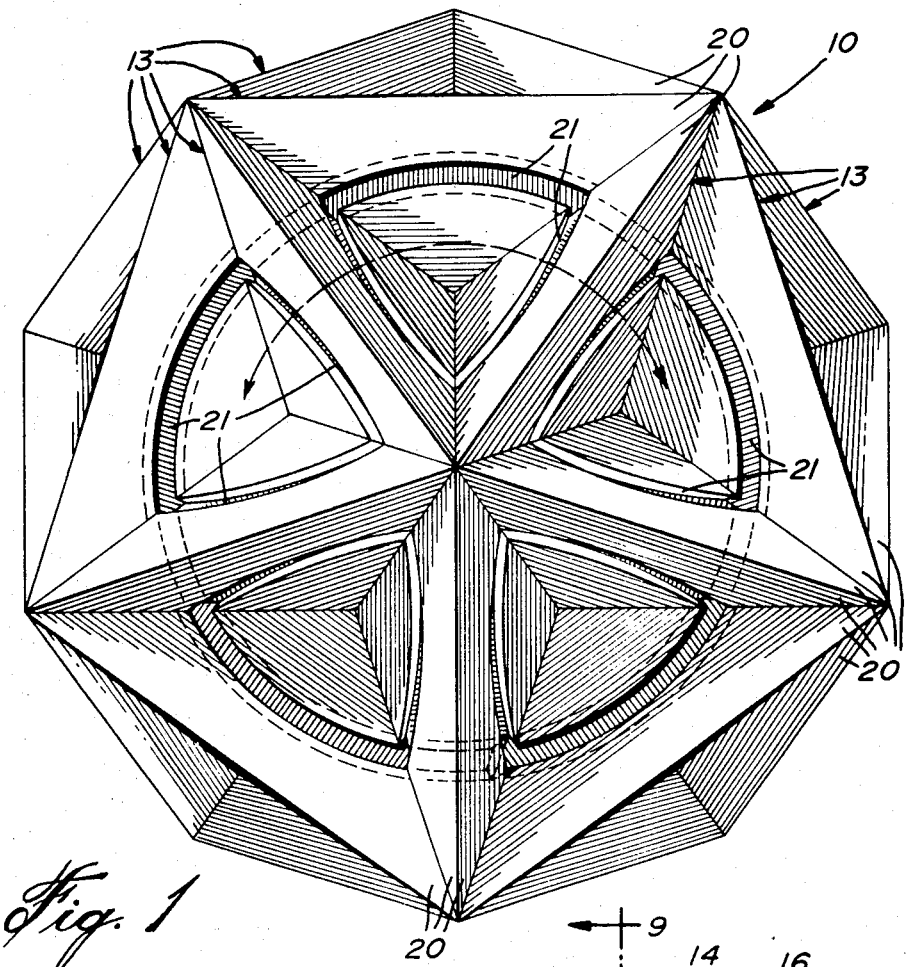
FIG. 1 is a plan view of a polyhedral puzzle according to the present invention.
Figure 2:
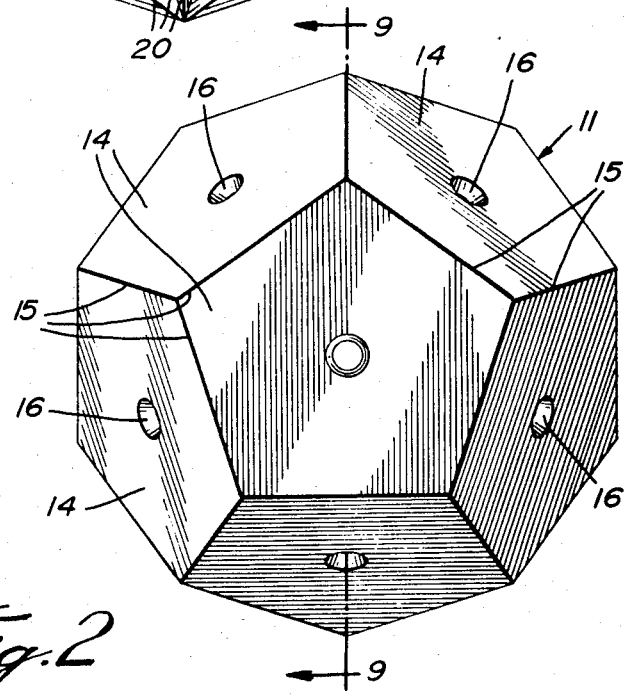
FIG. 2 is a plan view of a central body forming part of polyhedral puzzle of FIG. 1.

The illustrated polyhedral puzzle 10 includes a central body 11, intermediate bodies 12, and external bodies 13. The central body 11 takes the form of a regular polyhedron and more particularly of a regular dodecahedron. The central body 11 thus has all its faces 14 defined by the same congruent regular polygon and in particular, as shown, by the same congruent regular pentagon. Each such face 14 of the central body 11 defines 5 sides and apexes. Those sides of the faces 14 cooperatively form the 30 edges 15 of the dodecahedron. Each face 14 of the central body 11 is provided with a central aperture or hole 16.

Figure 3:
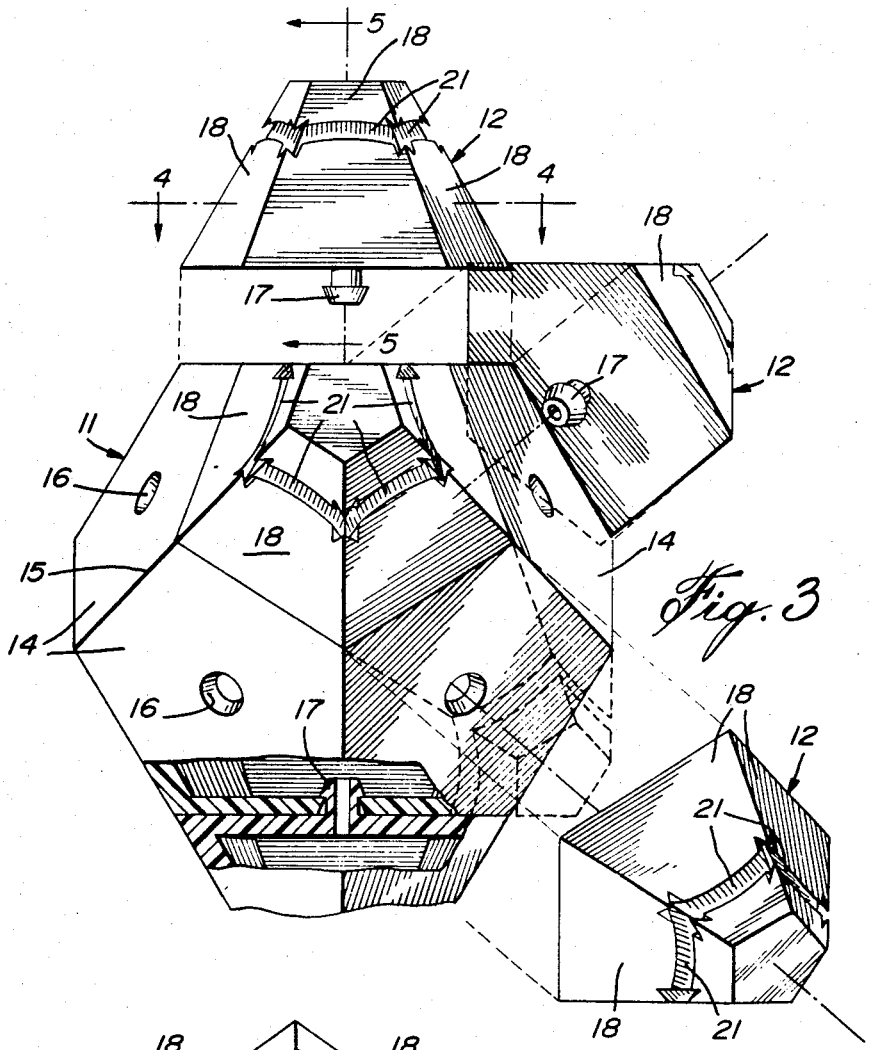
FIG. 3 is an exploded view of the central body and associated intermediate bodies forming part of the polyhedral puzzle of FIG. 1.
Figure 4:
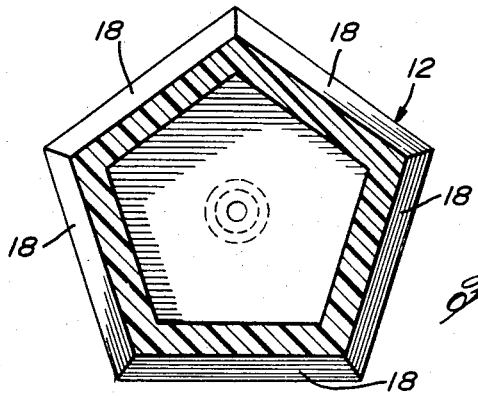
FIG. 4 is a cross-sectional view as seen along line 4—4 in FIG. 3.
Figure 5:
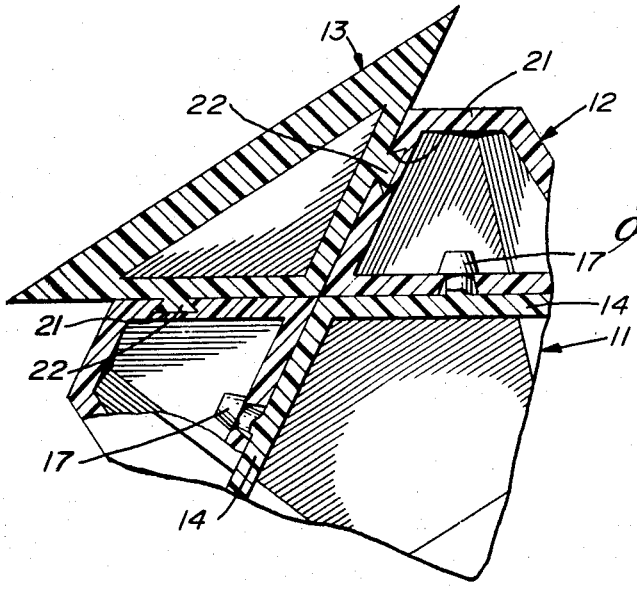
FIG. 5 is a partial cross-sectional view as seen along line 5—5 in FIG. 3.

The intermediate bodies 12 are positioned one over each of the faces 14. Each intermediate body 12 is a polyhedron of frustum shape whose base has the same shape as the corresponding face 14. Thus, the base of each intermediate body 12 has the shape of a regular pentagon congruent with the faces 14. A stud 17 projects from the base of each intermediate body 12, or from each face 14 of central body 11, and snaps into the corresponding aperture 16 to pivotally support each intermediate body 12 over the corresponding face 14. Each intermediate body 12 is formed with five lateral faces 18 each of isosceles trapezoid shape. As can be seen in FIG. 3, the intermediate bodies 12 are constructed and arranged relative to the central body 11 such that the set of lateral faces 18 that fan away from the edges 15 of each face 14 are coplanar with the latter; they could as well form all the same angle relative to the corresponding face 14.

Figure 6:
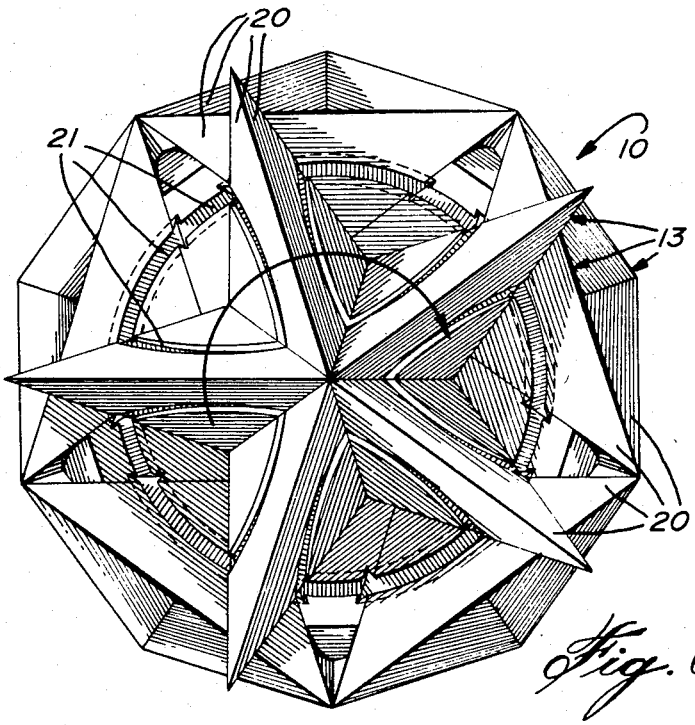
FIG. 6 is a similar view as in FIG. 1 but with some component elements in rotated position relative to a predetermined operative position.
Figure 7:
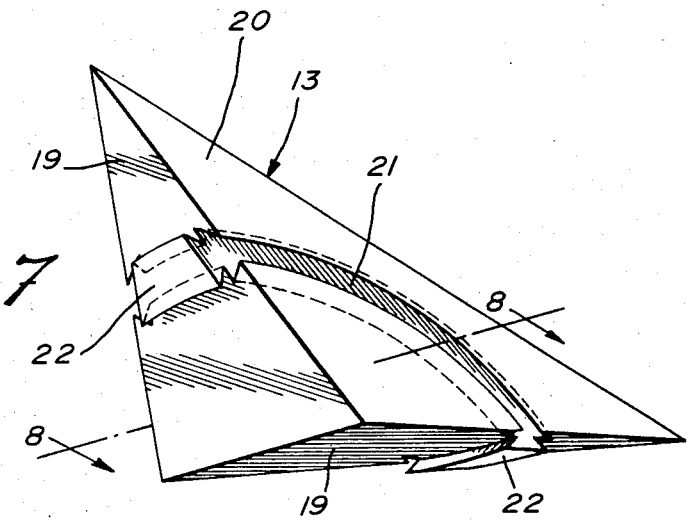
FIG. 7 is a perspective view of an external body forming part of the outer surface of the polyhedral puzzle.
Figure 8:
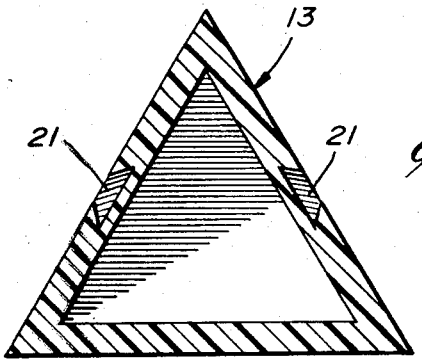
FIG. 8 is a cross-sectional view as seen along line 8—8 in FIG. 7.
Figure 9:
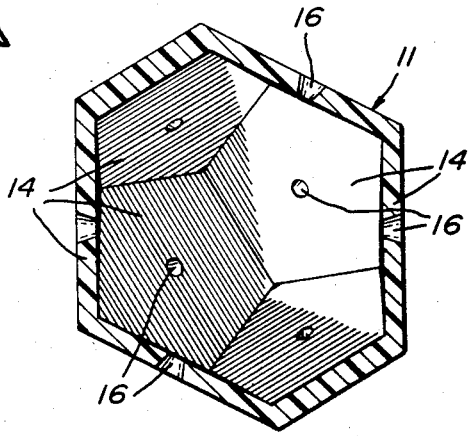
FIG. 9 is a cross-sectional view as seen along line 9—9 in FIG. 2.

The external bodies 13 are all of the same tetrahedral shape, as best shown in FIGS. 1 and 7, and they cooperatively define the entire outer surface of the cubic puzzle 10. Thus all what we see in FIGS. 1 and 6 are external bodies 13 and features of them. The external tetrahedron bodies 13 have a base defined by two base surfaces 19, formed by two of the faces of the corresponding tetrahedron. The two other faces 20 of each external tetrahedron body 13 constitute a pair of lateral faces.

The external bodies 13 are positioned one over each edge 15 of the central body 11 and such that its pair of base surfaces 19 extend over a corresponding pair of lateral faces 18 belonging to the pair of intermediate bodies 12 that are pivotally mounted on the faces 14 that cooperatively form the same edge 15. The external bodies 13 are arranged such that a set of lateral faces 20 fan around each face of the central body from its apexes all at the same angle relative to the corresponding face of the central body. Thus, in the illustrated embodiment, there is provided around each face 14 of the central body 11 a set of lateral faces 18 and a set of lateral faces 20 with those lateral faces fanning around the corresponding face 14 and extending coplanar with it. Thus, around each face 14 of the central body 11 there is formed a circumferentially continuous and uniform surface.

Each lateral face 18 and 20 is formed with an arcuate groove segment 21 arranged such that the set of lateral faces 18 of the intermediate bodies and set of lateral faces 20 of the external bodies that fan around each face of the central body have their groove segments 21 complementarily forming a circular slideway groove coaxial with the corresponding aperture 16 and stud 17.

The base surfaces 19 of the external bodies 13 are formed each with a sliding arc shaped projection 22 slidably retained into the groove segments 21 and constructed and arranged for slidable displacement along the circular slideway grooves.

It must be noted that there is thus formed around each intermediate body 12 a cluster of five (5) external bodies 13 that are carried by the same intermediate body through resting of one base surface 19 of the five external bodies against the five lateral faces 18 respectively and also through engagement of the corresponding arc-shaped projections 22 into the arcuate groove segments 21 respectively of the same lateral faces 18. The arcuate shape of the segments 21 and projections 22 holds the latter in the segments of the corresponding intermediate body 12 and causes bodily rotation of each such cluster with the corresponding intermediate body 12 to which they are so connected. Thus, each intermediate body 12 and its cluster of five external bodies 13 may be bodily rotated at will for rotative translation of any external body 13 that may thus be transferred from one cluster to another until its desired position is reached.

Each of the central body 11, intermediate bodies 12, and external bodies 13 constitutes a hollow body.

The lateral faces 20 of the external bodies are preferably colored in a predetermined pattern of colors that can be used to impose challenges to the user of the puzzle to reconstitute that pattern and other patterns of the colors on the external bodies.

What I claim is:

1. A polyhedral puzzle comprising a central body, of regular polyhedron shape, having faces defined by congruent regular polygons, as many intermediate bodies as there are central body faces, and each of frustum shape defining a base face of the same congruent regular polygon shape as the central body faces and defining equally-inclined lateral faces of isosceles-trapezoidal shape, the base face of each intermediate body resting over a respective central body face, pivot means pivoting the center of the base face of each intermediate body to the center of a respective central body face, said intermediate bodies rotatable relative to said central body to a position in which each edge of the base face of said intermediate body coincides with a respective edge of said central body, as many external bodies as there are lateral faces of said intermediate bodies, each external body being of tetrahedron shape forming a pair of base surfaces and a pair of lateral faces, said base surfaces being inclined relative to each other and meeting at a common straight edge, said straight edge being positioned over a respective one of each edge of the central body in said rotated position of said intermediate bodies with the two base faces of each external body respectively engaging over a pair of lateral faces defined by a pair of adjacent intermediate bodies, respectively, said lateral faces of said external bodies being co-planar with the respective lateral faces of adjacent intermediate bodies in said rotated position, and a circular slideway system slidably connecting each external body rotatably onto the corresponding pair of adjacent intermediate bodies, each circular slideway system being coaxial with a respective pivot means of said intermediate bodies on said external body and including circular groove segments and projections slidably retained in said groove segments and formed at the lateral faces of said intermediate bodies and on said base surfaces of said external bodies, each external body being capable of rotation with respect to said central body about the pivot axis of either one of two adjacent intermediate bodies.

2. A polyhedral puzzle as defined in claim 1, wherein said central body is a regular dodecahedron with its faces forming a regular pentagon and said intermediate bodies have a base face in the shape of a regular pentagon.

3. The polyhedral puzzle as defined in claim 1, wherein said circular groove segments of said circular slideway systems are formed in the lateral faces of said intermediate bodies and of said external bodies, and said projections protrude from the base surfaces of said external bodies.

* * * * *